United States Patent [19]

Shimokawabe

[11] Patent Number: 4,741,669

[45] Date of Patent: May 3, 1988

[54] SHROUD

[76] Inventor: Tatsuji Shimokawabe, 24-11, Asahi-cho, Sagamihara-shi, Kanagawa-ken, Japan

[21] Appl. No.: 15,558

[22] Filed: Feb. 13, 1987

Related U.S. Application Data

[63] Continuation of Ser. No. 603,505, Apr. 24, 1984, abandoned.

[30] Foreign Application Priority Data

Apr. 27, 1983 [JP] Japan ..... 58-63581[U]

[51] Int. Cl.[4] ..... F04D 29/52

[52] U.S. Cl. ..... 415/213 C; 415/196; 24/615

[58] Field of Search ..... 415/213 C, 200, 217, 415/219 R, 196, 197, 201; 123/41.49; 403/354, 360, 381; 24/615, 616

[56] References Cited

U.S. PATENT DOCUMENTS

| | | | |
|---|---|---|---|
| 2,863,634 | 12/1958 | Chamberland et al. | 415/219 R |
| 3,051,952 | 8/1962 | Pifer | 24/616 X |
| 3,635,285 | 1/1972 | Davis | 415/213 C UX |
| 4,018,297 | 4/1977 | Haupt | 123/41.49 X |
| 4,353,680 | 10/1982 | Hiraoka et al. | 415/219 R |

FOREIGN PATENT DOCUMENTS

| | | | |
|---|---|---|---|
| 2250541 | 4/1974 | Fed. Rep. of Germany | 403/364 |
| 269757 | 7/1950 | Switzerland | 403/381 |
| 968914 | 9/1964 | United Kingdom | 24/616 |
| 17624 | 8/1984 | United Kingdom | 403/381 |

*Primary Examiner*—Robert E. Garrett
*Assistant Examiner*—Joseph M. Pitko
*Attorney, Agent, or Firm*—Leonard Tachner

[57] ABSTRACT

An improved radiator shroud consists of a main upper-shroud and a semicircular lower-shroud to be attached to the cut-off portion of the cylindrical opening of the main upper-shroud. The lower-shroud is provided with more than two U-shaped stoppers along its outer periphery, the U-shaped stoppers being interlocked into the slits made along the outer periphery of the cut-off portion.

2 Claims, 5 Drawing Sheets

SHROUD

This is a continuation of parent application Ser. No. 603,505 filed Apr. 24, 1984, now abandoned.

BACKGROUND OF THE INVENTION

The present invention relates to an improved shroud which is mainly installed to a radiator of a car in order to guide the wind from a motor fan or an engine fan. In general, a shroud is separably formed of a main upper-shroud and a lower-shroud due to the necessity of it being attached at the narrow space between a radiator and an engine. They are usually attached to each other in the following order: the main upper-shroud is first attached to a radiator, and then the lower-shroud is combined with the upper-shroud after the radiator and the engine are fixed to a car body.

The main upper-shroud A of the conventional shroud, as shown in FIG. 1, has many engaging holes along the outer periphery of the cut-off portion of the cylindrical opening 2, while the semicircular lower-shroud B, as shown in FIG. 2, has clips 4 as in FIG. 3 along the outer periphery thereof. The engagement of the main upper-shroud and the lower-shroud has been effected by interlocking the clips 4 into the engaging holes (see for example, laying open No. 58-100298, Japanese Utility Model). Such clips 4 engage easily with the corresponding holes 3 and, therefore, the engagement of the lower-shroud B and the main upper-shroud A can be easily and securely effected even at a narrow space between a radiator and an engine.

The conventional shroud as mentioned above, however, is not free from a problem that there is some difficulty in detaching the lower-shroud B from the main upper-shroud A when it is necessary to do so, because these clips 4 are made of stiff and short projecting clips.

The present invention has been made in order to eliminate the above problem. The essential object of the present invention is, therefore, to provide an improved shroud with a structure which enables the easy and secure attachment and detachment of the lower-shroud when necessary. This object can be accomplished according to the present invention consisting of a main upper-shroud and semicircular lower-shroud to be attached to the cut-off portion of the cylindrical opening of the former in which the outer periphery of the lower-shroud is provided with more than two U-shaped stoppers having a protrusion thereon, the U-shaped stoppers being interlocked into the square-shaped slits provided along the outer periphery of the cut-off portion. The present invention will be explained in more detail by referring to the drawings.

BRIEF DESCRIPTION OF THE DRAWINGS

A detailed description of the invention will be made with reference to the accompanying drawings wherein like numerals designate corresponding parts in the several figures. These drawings are to scale.

FIG. 1 being a back view of the main upper-shroud, FIG. 2 being a back view of the lower-shroud, and FIG. 3 being an enlarged sectional view of the clip provided on the lower-shroud.

FIG. 4 being a back view of the main upper-shroud, FIG. 5 being a back view of the lower-shroud, and FIG. 6 being an enlarged diagonal view showing the essential part of the invention in which the U-shaped stoppers are detached from the slits of the main upper-shroud.

DETAILED DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention, since the scope of the invention is best defined by the appended claims.

Structural and operational characteristics attributed to forms of the invention first described, shall also be attributed to forms later described unless such characteristics are obviously inapplicable or unless specific exception is made.

Figure 1:
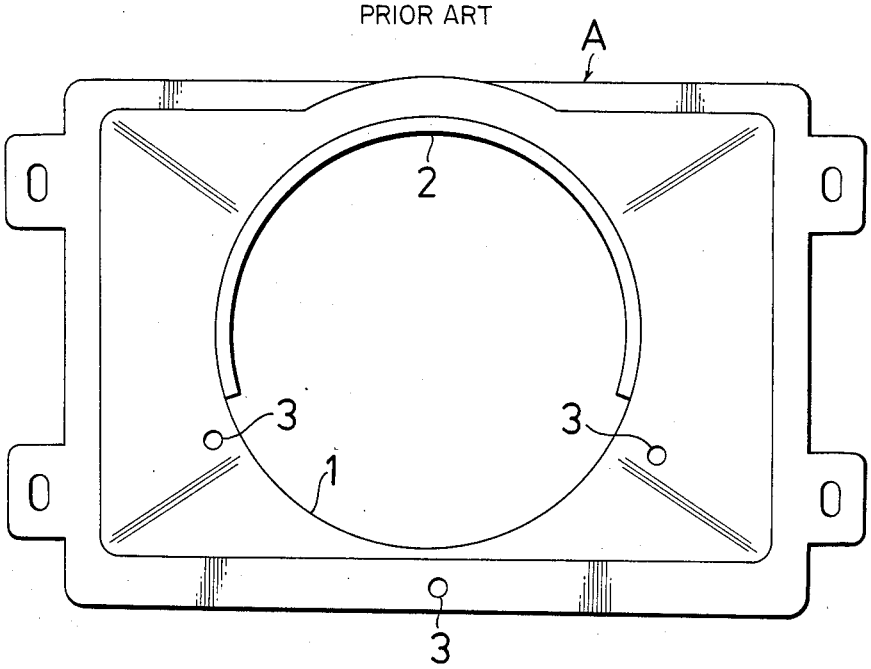
FIG.1 PRIOR ART
FIGS. 1 to 3 show a conventional shroud.
Figure 2:
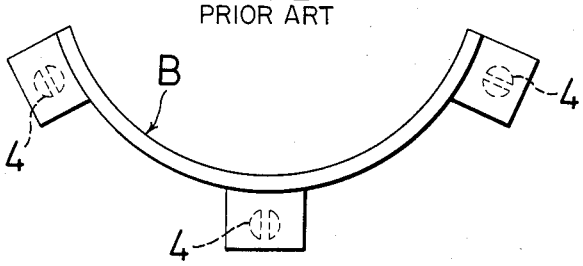
FIG.2 PRIOR ART
Figure 3:
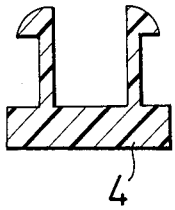
FIG.3 PRIOR ART
Figure 4:
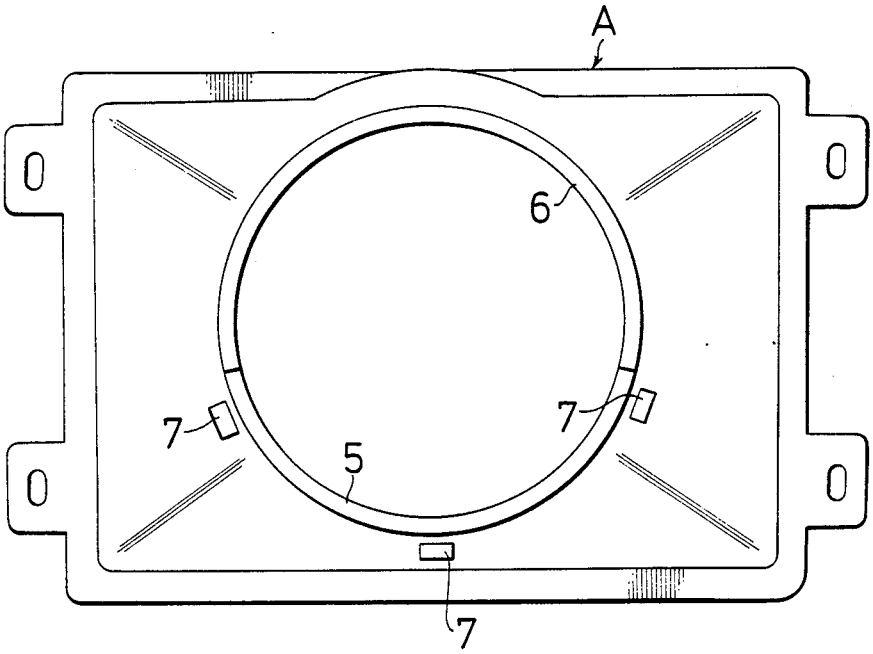
FIGS. 4 to 6 show the first embodiment of the present invention.
Figure 5:
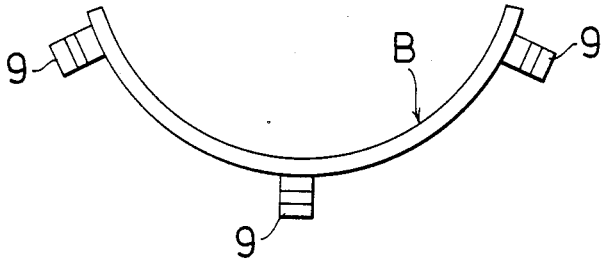
Figure 6:
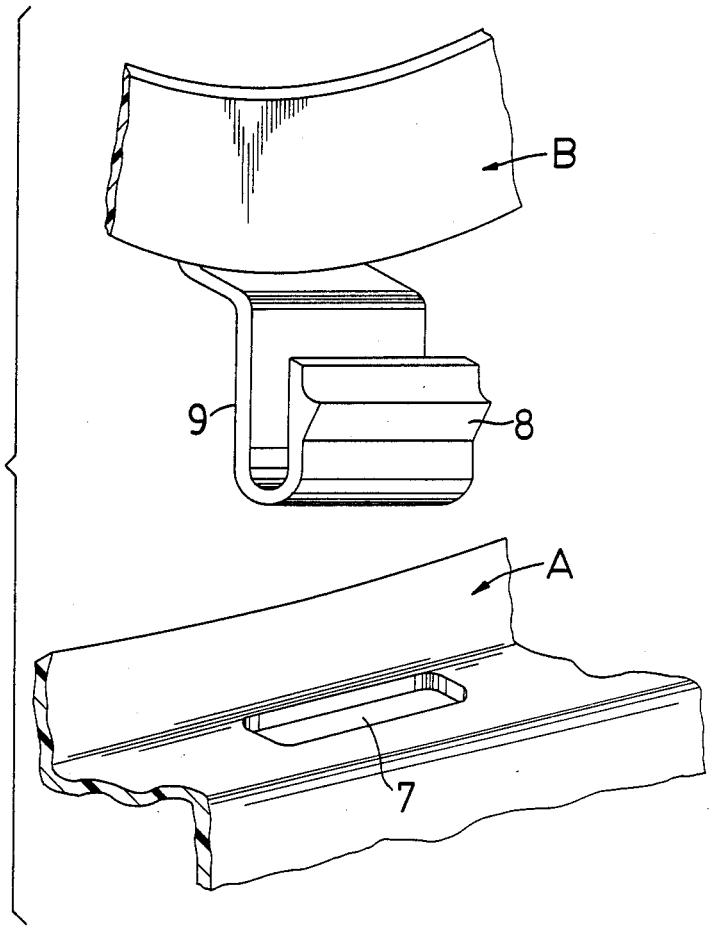
Figure 7:
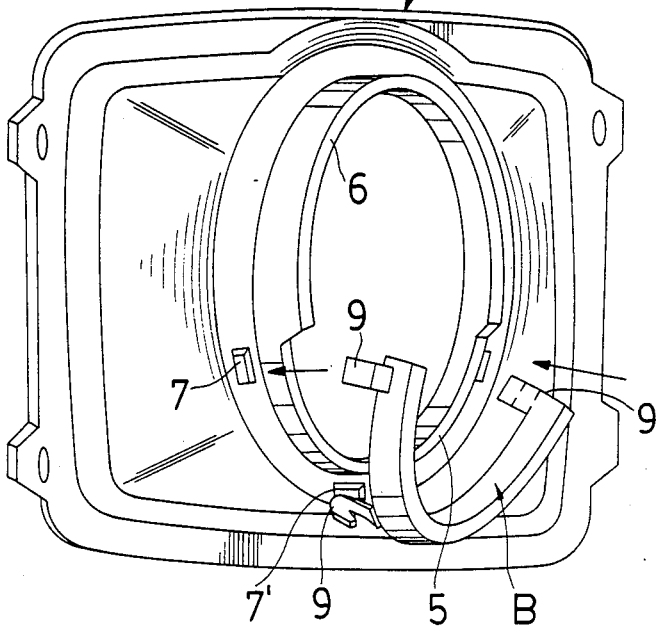
FIG. 7 is a diagonal view of the shroud according to the present invention, showing the state where the lower-shroud is attached to the main upper-shroud.
Figure 8:
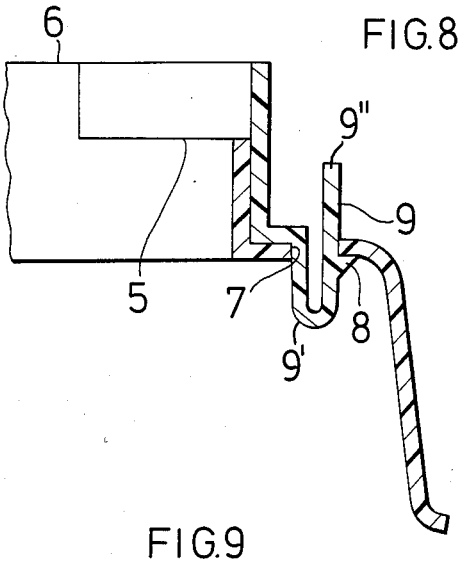
FIG. 8 is an enlarged sectional view of the essential part of the shroud according to the present invention, showing the state where the lower-shroud is detached from the main upper-shroud.

FIGS. 4 to 6 show the first embodiment of the present invention. The main upper-shroud A is of a square-shaped body made of a synthetic resin material and provided, in the middle part thereof, with a cylindrical opening 6 having a cut-off portion 5 at the lower part. Square-shaped slits 7 as shown in FIG. 6 are made in the middle part as well as on either side of the outer periphery of the cut-off portion 5. On the other hand, the lower-shroud B is a substantially semicircular means made of a synthetic resin material, the outer periphery of which is provided with large U-shaped stoppers 9 having protrusions 8 as shown in FIG. 8 that correspond to the above-mentioned slits 7. Protrusions 8 define a barb-shaped protrusion on an outer periphery of U-shaped stoppers 9 to provide a positive locking effect between stoppers 9 and upper shroud A. The overall contour of stoppers 9 allows such to be releasably compressible on either of opposing sides of slits 7 for ease of removal of stoppers 9. The lower-shroud B is engaged with the main upper-shroud A by interlocking the U-shaped stoppers 9, respectively, into the square-shaped slits 7 which are made along the outer periphery of the cut-off portion 5. Stoppers 9 each have a rounded base end portion 9' and a projecting plate 9''.

The engagement of the lower-shroud and the main upper-shroud A is done as follows: First, the U-shaped stopper 9 at the lower middle part of the lower-shroud B is interlocked into the slit 7 at the lower middle part of the main upper-shroud A which has already been attached to the radiator, and then, the engine as well as the radiator attached with the main upper-shroud A is fixed to a car body and, thereafter, the U-shaped stopper 9 on either side of the lower-shroud B is interlocked into the corresponding slit 7. U-shaped stoppers 9 can be pressed into slits 7 for tight engagement and also can be removed by bending the projecting plate 9'' towards the base end portion 9'.

According to the present invention, it is possible to engage the lower-shroud B with the main upper-shroud A even at the narrow space between a radiator and an engine which are fixed to a car body. Moreover, the spring action of the flexible U-shaped stoppers 9 ensures the secure engagement of the lower-shroud B with the main upper-shroud A and also prevents the disengagement of them due to the vibrations and the like. If necessary, the detachment of the lower-shroud B from the main upper-shroud A can be easily effected by bending inwardly each projecting plate 9 of the U-shaped stoppers 9 with a finger, as shown in FIG. 8, so that the U-shaped stoppers 9 may be detached out of the slits 7.

The lower-shroud of this first embodiment has three U-shaped stoppers 9 along the outer periphery thereof, but it is possible to provide more than three. In this case, it will be seen that the main upper-shroud A should have more than three slits 7.

As for the material of the shroud, the main upper-shroud A can be made of metal as well as synthetic resin; but, on the other hand, the lower-shroud B should be preferably made of synthetic resin.

DESCRIPTION OF ALTERNATE EMBODIMENT

FIGS. 9 to 13 show the second embodiment of the present invention. In this second embodiment, the main upper-shroud A is also provided with slits 7 as in the first embodiment, but the slit at the lower end portion is omitted as seen from FIG. 9. Corresponding to it, the U-shaped stopper at the lower end portion of the lower-shroud B is omitted as seen from FIG. 10.

Figure 9:
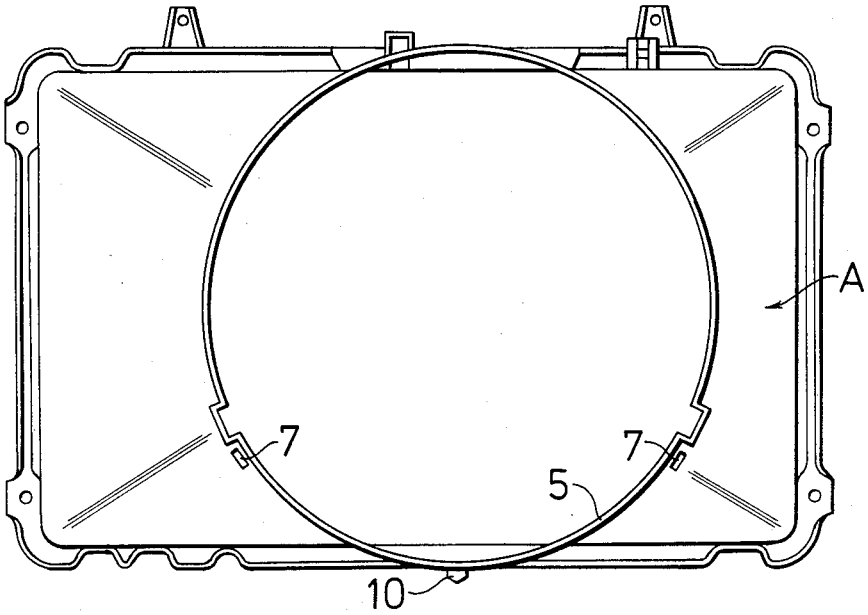
FIG. 9 is a back view of the main upper-shroud of the second embodiment according to the present invention.
Figure 10:
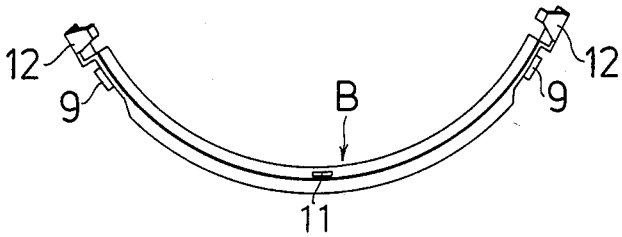
FIG. 10 is a diagonal view of the lower-shroud shown in FIG. 9.
Figure 11:
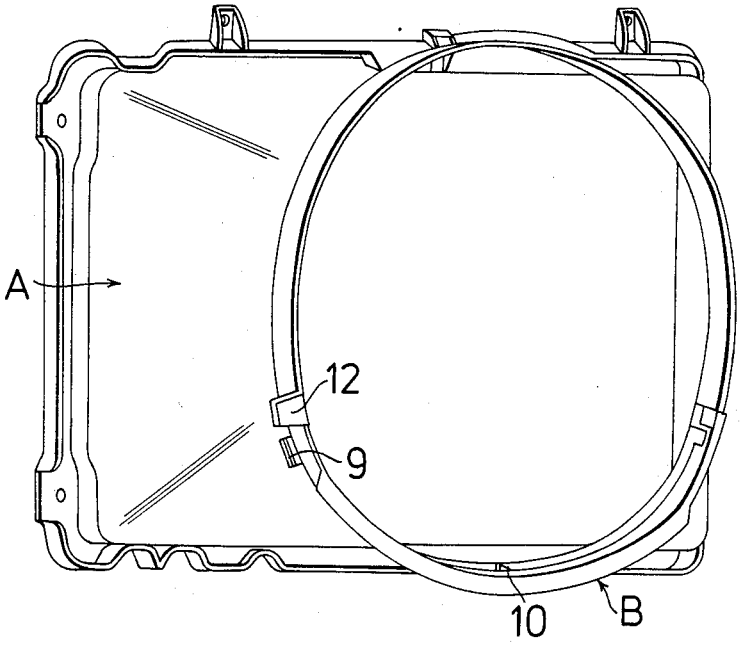
FIG. 11 is a diagonal view of the second embodiment of the invention.
Figure 12:
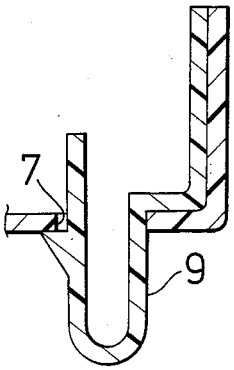
FIG. 12 is a sectional view showing the state where the U-shaped stopper is attached.
Figure 13:
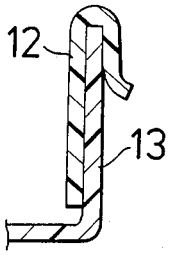
FIG. 13 is a sectional view showing the engagement of the interlocking means and the box-like protrusion.

FIGS. 9 and 10 show that the lower end portions of the main upper-shroud A and the lower-shroud B are, respectively, provided with a protrusion 10 and an aperture 11 to receive it so as to determine the position of the lower-shroud B at the time of attachment, and also to prevent the dropping-off of the lower-shroud B due to the vibrations and the like after it is attached to the main upper-shroud A. The engagement of the protrusion 10 and the aperture 11 can produce the same effect as that of the U-shaped stopper 9 and the slit 7 in the first embodiment.

In the second embodiment, so as to make the engagement of the main upper-shroud A and the lower-shroud B more reliable, each end of the lower-shroud B is provided with an interlocking means 12 which can bend outwardly, while each end portion of the main upper-shroud A is provided with a box-like protrusion 13 which receives the interlocking means 12. These interlocking means 12,12 are covered and fixed over the box-like protrusions 13,13 from above. The front ends of the interlocking means 12, 12 have flared portions which help engage tightly with the walls of the box-like protrusions 13, 13 so that the means 12, 12 are prevented from moving or getting loose.

As in the first embodiment, the second embodiment can bring about easy and secure attachment of a lower-shroud to a main upper-shroud and, at the same time, easy detachment of the former from the latter whenever it is necessary.

Intending to claim all novel, useful and unobvious features shown of described, I make the following claims:

1. An improved shroud consisting of a main upper-shroud and a semicircular lower-shroud to be attached to the cut-off portion of the cylindrical opening of said main upper-shroud, wherein said lower-shroud is provided with more than two integral U-shaped stoppers extending from the outer periphery thereof, said U-shaped stoppers being releasably interlocked into the slits made along the outer periphery of said cut-off portion including a singular barb-shaped protrusion on an outer periphery of each of said U-shaped stoppers for providing a positive locking between said U-shaped stoppers and said main upper shroud, said U-shaped stopper being releasably compressible on either of opposing sides of said slits for removal of said U-shaped stoppers from said interlocking relationship.

2. An improved shroud as claimed in claim 1, wherein said main upper-shroud is provided with a protrusion, said lower-shroud being provided with a corresponding aperture, said protrusion being pushed into said aperture to form an interlocking relationship in addition to the interlocking relationship of said U-shaped stoppers and said slits.

* * * * *